343-700 MS: AU 256 EX
3/4/80 OR 4,191,959

United States Patent [19]
Kerr

[11] 4,191,959
[45] Mar. 4, 1980

[54] MICROSTRIP ANTENNA WITH CIRCULAR POLARIZATION

[75] Inventor: John L. Kerr, Neptune, N.J.

[73] Assignee: The United States of America as represented by the Secretary of the Army, Washington, D.C.

[21] Appl. No.: 925,074

[22] Filed: Jul. 17, 1978

[51] Int. Cl.² ..... H01Q 1/38
[52] U.S. Cl. ..... 343/700 MS; 343/761
[58] Field of Search ..... 343/700 MS, 829, 846, 343/761

[56] References Cited

U.S. PATENT DOCUMENTS

| | | | |
|---|---|---|---|
| 3,778,717 | 12/1973 | Okoshi et al. | 343/700 MS |
| 3,921,177 | 11/1975 | Munson | 343/700 MS |
| 4,060,810 | 11/1977 | Kerr et al. | 343/700 MS |

OTHER PUBLICATIONS

Weinschel; A Cylindrical Array of Circularly Polarized Microstrip Antenna, IEEE-AP-S, Int. Symp. Record, 1975, pp. 177-180.

*Primary Examiner*—Eli Lieberman
*Attorney, Agent, or Firm*—Nathan Edelberg

[57] ABSTRACT

A microstrip antenna is disclosed having an etched metal radiator element including a polarizing patch consisting of a two dimensional removal of metallization from the central portion of the radiator element with one dimension of the polarization patch being greater than the other dimension e.g. an elongated rectangle and selectively oriented with respect to the input axis whereby, for example, circular polarization is achieved by means of orienting the polarization patch substantially 45° with respect to the input axis.

16 Claims, 12 Drawing Figures

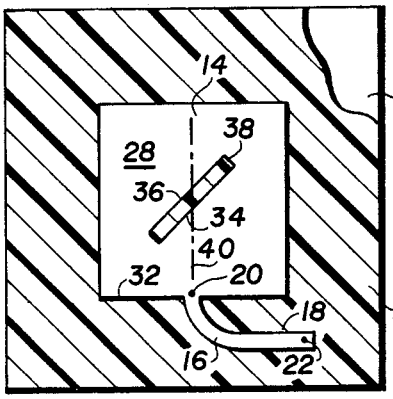
FIG. 4
FIG. 6
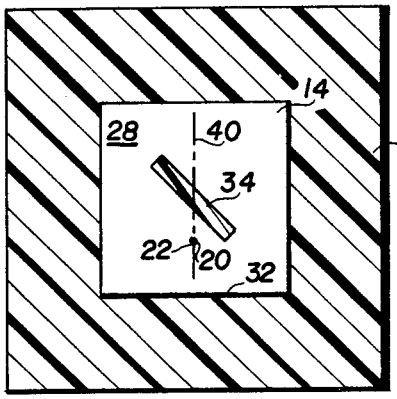
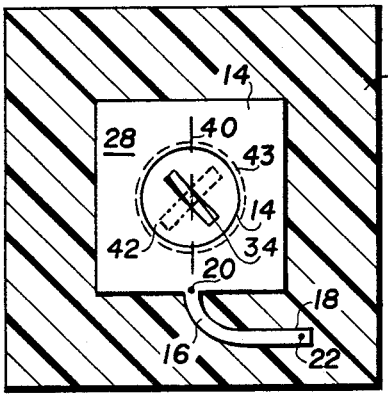
FIG. 7
FIG. 8
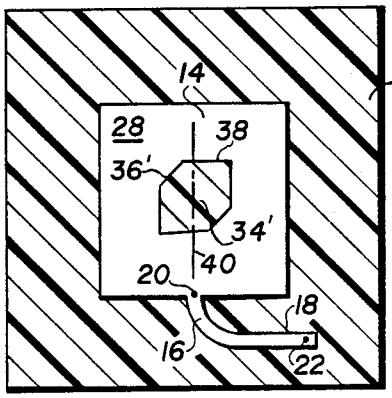
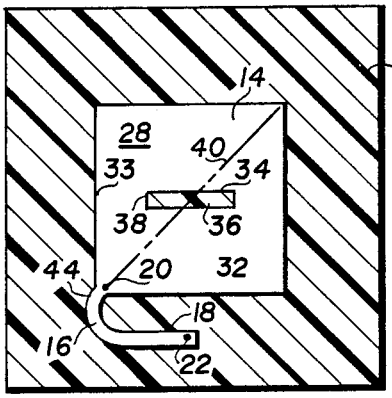
FIG. 9
FIG. 10
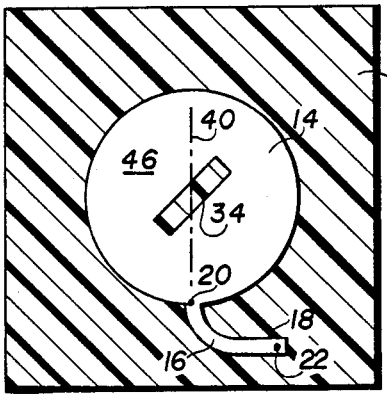
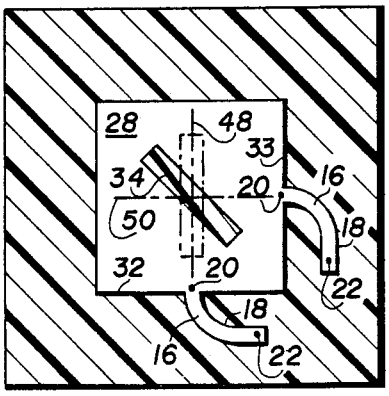
FIG. 11

CIRCULAR POLARIZATION RADIATION PATTERN FOR FIGURE 4

MICROSTRIP ANTENNA WITH CIRCULAR POLARIZATION

The invention described herein may be manufactured and used by or for the Government for governmental purposes without the payment of any royalties thereon or therefor.

FIELD OF THE INVENTION

This invention relates to microstrip antennas and more particularly to means for implementing polarized embodiments thereof.

BACKGROUND OF THE INVENTION

As is well known to those skilled in the art, a microstrip antenna is a printed circuit device in which the radiating element is a patch of metallization etched on one side of a dualclad dielectric circuit board. A typical example of such a device is disclosed in a prior art patent of the subject inventor namely U.S. Pat. No. 4,060,810, entitled, "Loaded Microstrip Antenna", John L. Kerr, et al., which patent issued on Nov. 29, 1977. In that patent a microstrip antenna is disclosed having a symmetrical i.e. square patch of metallization removed from the central portion of the metal radiator element with the sides of the patch being orthogonal to the input transmission line so that current flowing across the patch is forced to deviate around the area of removal and therefore have a longer path which results in lowering the resonant frequency of radiation of the antenna. Additionally, microstrip antenna structures adapted to produce polarized radiation are also known and are disclosed in U.S. Pat. No. 3,921,177, entitled "Microstrip Antenna Structures and Arrays", R. F. Munson, which issued on Nov. 18, 1975, as well as in a publication entitled "A Cylindrical Array of Circularly Polarized Microstrip Antenna" by Henry D. Weinschel, published in the 1975 IEEE-AP-S International Symposium Record, at pages 177–180. In each of the latter prior art structures, circular polarization of the radiation is achieved by appropriately feeding an etched metal radiator having a continuous radiating surface, i.e. one in which there is no portion of the etched metal radiator removed from an interior portion of the radiator.

SUMMARY OF THE INVENTION

Briefly, the subject invention follows from a discovery that the polarization of the radiated energy from a microstrip antenna can be selectively controlled by the use of a polarization patch constituting the removal of a non-symmetrically shaped pattern such as an elongated rectangle from the inner portion of the etched metallization forming the radiator element with the polarization patch being selectively oriented with respect to the input axis coincident with the feed line coupled to the radiator element.

BRIEF DESCRIPTION OF THE DRAWINGS

The present invention will be more clearly understood when the following detailed specification is considered in connection with the accompanying drawings, in which:

FIG. 4 is a plan view of one embodiment of a microstrip antenna having a polarizing patch in accordance with the subject invention;

FIGS. 6 through 11 are plan views of other embodiments of microstrip antennas having respective polarizing patches in accordance with the subject invention.

DESCRIPTION OF THE PREFERRED EMBODIMENTS

Figure 1A:
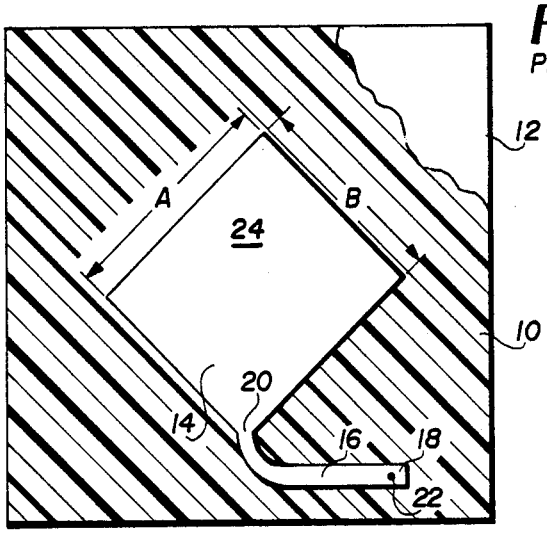
FIG. 1A PRIOR ART
FIGS. 1A and 1B are illustrative of prior art microstrip antennas providing circular polarization of the radiated energy.

Referring now to the drawings wherein common reference numerals are meant to designate correspondingly like elements throughout, typically a microstrip antenna such as shown in FIG. 1A is comprised of a sheet of well known dielectric material 10 having a ground plane 12 formed on the under side thereof and consisting of a layer of metallization such as copper formed on substantially the entire under surface. On the front surface of the dielectric sheet 10 an etched pattern of metallization 14 also preferably copper is formed within the boundaries or outside edges of the dielectric sheet 10. This pattern defines the metal radiator element. A relatively narrow strip of metallization 16 is also formed on the front surface of the dielectric sheet 10 which is adapted to couple the input signal applied via a connector 18 on the ground plane side of the dielectric sheet to the radiator feed point 20 with the strip of metallization 16 acting as a microstrip impedance matching transformer in a manner well known to those skilled in the art. Reference is made to the aforementioned U.S. Pat. No. 4,060,812 in this regard.

Figure 2:
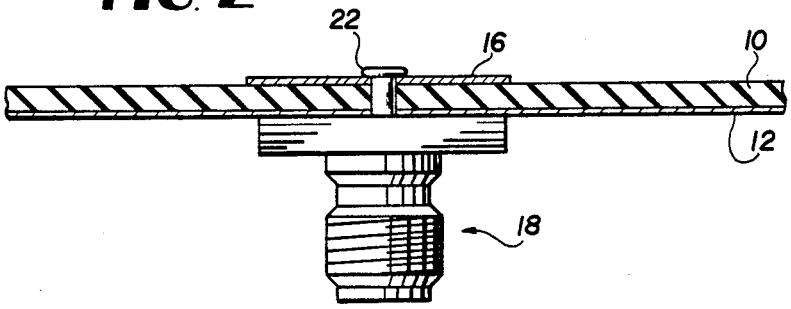
FIG. 2 is a fragmentary cross sectional view of a typical microstrip antenna and being illustrative of the signal input connection to the radiating element.

FIG. 2 is intended to further illustrate the details of the input signal coupling. In FIG. 2 reference numeral 18 denotes a coaxial connector which as noted above is mounted on the back side of the dielectric sheet 10. A metal feed-through element 22 extends from the inner conductor, not shown, of the connector 18 through the dielectric sheet 10 and makes electrical contact with the metallization on the front side such as the matching transformer strip 16. As will be shown when the embodiment shown in FIG. 4 is considered, the transformer strip 16 in some instances may be deleted with the feed-through element 22 making direct contact with the etched radiating element 10 on the front surface.

Figure 1B:
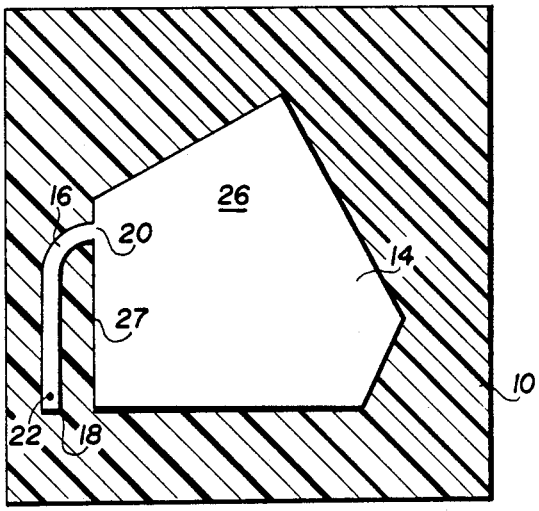
FIG. 1B PRIOR ART

With respect to the microstrip antenna configurations shown in FIGS. 1A and 1B, what is intended to be shown there are two prior art configurations for implementing circularly polarized microstrip radiators having a single input signal feed. In the configuration shown in FIG. 1A, the feed point 20 is at the corner of a diamond shaped radiating element 24 where the dimension A is made slightly longer than one half the operational wavelength while the dimension B is made slightly shorter. For a predetermined operating frequency conjugate impedances exist in orthogonal component directions A and B across the metallization 14 which thereby provides the required 90° phase difference causing component radiated fields which have conjugate phases or in other words, the total radiated field will be circularly polarized. This concept is set forth in detail in the above mentioned U.S. Pat. No. 3,091,177.

With respect to the microstrip antenna shown in FIG. 1B, circular polarization of the radiation is achieved by means of unsymmetrically shaped pentagon radiating element 26 having a feed point 20 along the vertical side 27. This configuration is described in the aforementioned Weinschel article appearing in the Proceedings of the 1975 IEEE/AP-S International Symposium. In both prior art structures the radiating elements 24 and 26 have surface metallization 14 which is continuous within its perimeter. It has been shown, for example, in the applicant's prior patent U.S. Pat. No. 4,060,810 that a size reduction of the radiating element can be achieved for a given operating frequency by the removal of a symmetrically shaped patch of metallization from the central portion of the radiating element.

In accordance with the present invention, it has since been discovered that if the removed patch from a microstrip antenna fed at the midpoint of an edge is not symmetrically shaped, e.g. square or round, but rather is asymmetrically shaped relative to the input axis such as in the form of an elongated rectangle for a center fed antenna, the patch has an effect on the input polarization depending upon its orientation relative to the input axis. This is due to the fact that different electrical path lengths in the transmission line between the radiator and the ground plane are provided capable of producing the required conjugate phases to implement a circularly polarized radiated field. This is due to the fact that for an elongated rectangle, for example, electrical path length in the transmission line between the radiator and the ground plane is greater when the currents are forced to flow around the larger dimension of the rectangle. Stated another way with the long dimension parallel with the input axis a lesser effect results while an input axis perpendicular to the long dimension results in a greater effect as evidenced by the curves shown in FIG. 3, which if the dimensions of the elongated patch are properly adjusted, a 90° phase difference between two components will result and circular polarization will be implemented with the phase shifting being accomplished in the transmission line medium rather than by introducing asymmetry into the outer perimeter of the radiating element.

With the foregoing in mind, a family of microstrip radiators has evolved which is adapted to provide any desired type of polarization, more particularly circular polarization, for a single input feed for a particular operating frequency.

Figure 5:
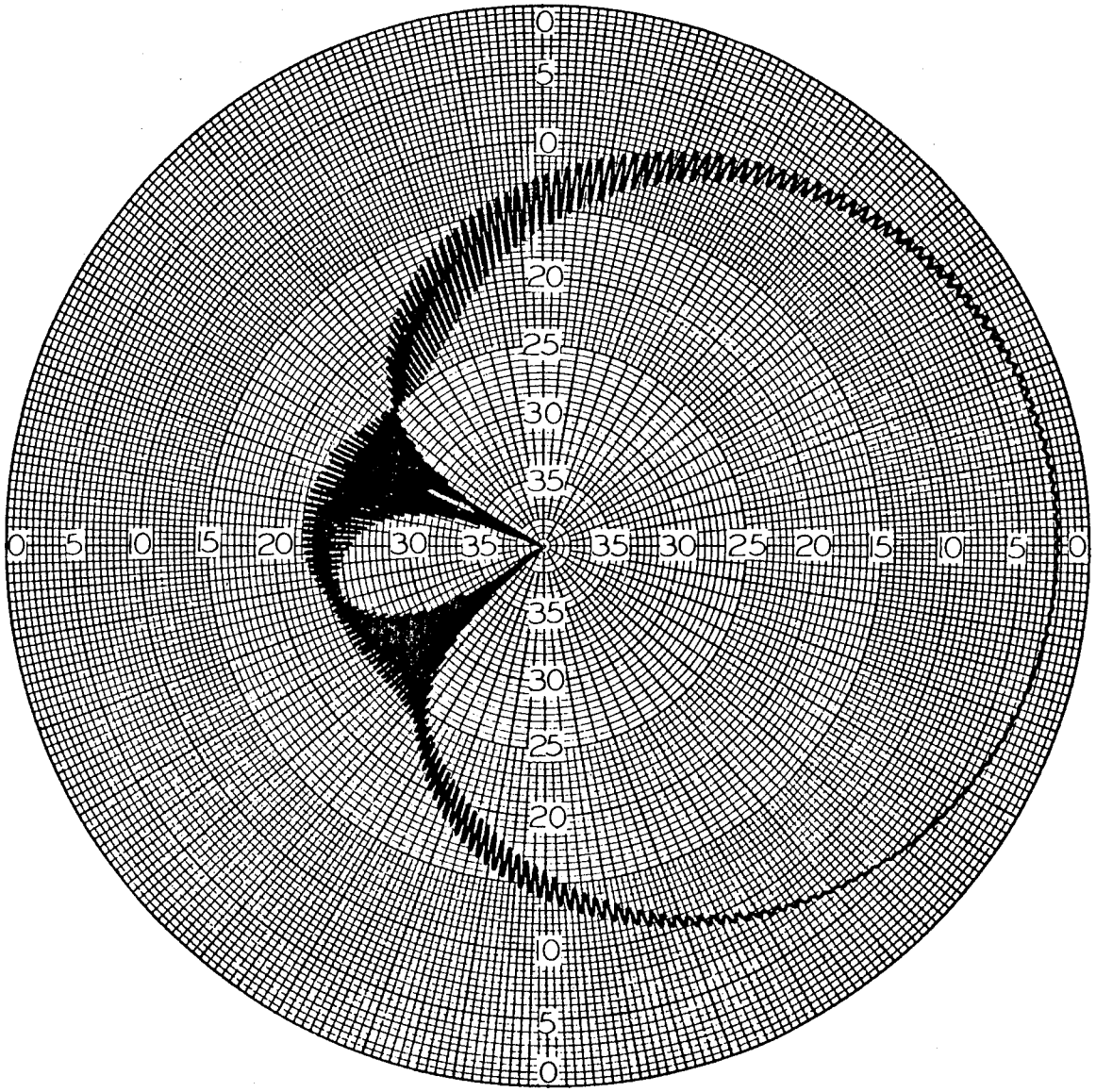
FIG. 5 is a graph illustrative of a typical radiation pattern for circular polarization for the embodiment disclosed in FIG. 4.

Referring now to FIG. 4, the embodiment shown thereat includes metallization 14 on the dielectric sheet 10 which is etched in the form of a square radiating element 28, which is center fed at the feed point 20 along the lower edge 32 by means of the impedance matching microstrip transformer element 16 which couples to the feed through element 22. In the central portion of the radiating element 28 an elongated rectangular patch 34 of metallization is removed having a long dimension or major axis 36 and a relatively short dimension or minor axis 38, typical values being 0.80 inches and 0.1 inches, respectively, for a square radiating element which is 2.680 inches on a side. The removed portion 34 hereinafter referred to as the polarizing patch is oriented at an angle of 45° with respect to the input axis 40 which is perpendicular to the edge 32. By considering the input electrical field to be resolved into orthogonal components parallel to the long and short dimensions 36 and 38, the component parallel with the long dimension 36 will see a shorter path length or higher resonant frequency while the perpendicular component will see a longer path length or lower resonant frequency in accordance with the teachings of applicant's prior patent, U.S. Pat. No. 4,060,810. By properly selecting the dimension of the asymmetrical polarizing patch 34, circular polarization of a radiation pattern typically as shown in FIG. 5 will be produced in accordance with the foregoing discussion.

Referring now to the embodiment shown in FIG. 6, it is like the embodiment shown in FIG. 4 with the exception that an alternate feed point arrangement is disclosed. In this embodiment, the feed point 20 is made not along the outside edge 32 of the radiating element 28, but the feed-through element 22 is positioned inwardly towards the center of the radiating element 28 along the center line 40 adjacent the lower edge of the polarizing patch 34, thus deleting the matching microstrip transformer.

With respect to the embodiment shown in FIG. 7, there is disclosed a means for providing a variable polarization microstrip antenna by fabricating the polarizing patch 34 on a rotatable circular disc portion 42 of the radiating element 28 which is adapted to fit in a central hole 43 provided through the square radiator element and the underlying dielectric sheet 10 and ground plane 12. The metallization 14' of the disc portion 42 is adapted to underlie the metallization 14 of the radiator element 28 so as to make a complete electrical circuit on the radiator side of the antenna. Although not shown in FIG. 7, the ground plane metallization on the back side of the dielectric sheet 10 also encompasses the disc 42 and is adapted to make electrical contact with the surrounding ground plane metallization to complete the ground plane circuit between the disc and the main ground plane metallization. This can be effected in any desired manner within the skill of one familiar with this type of technology.

Figure 3:
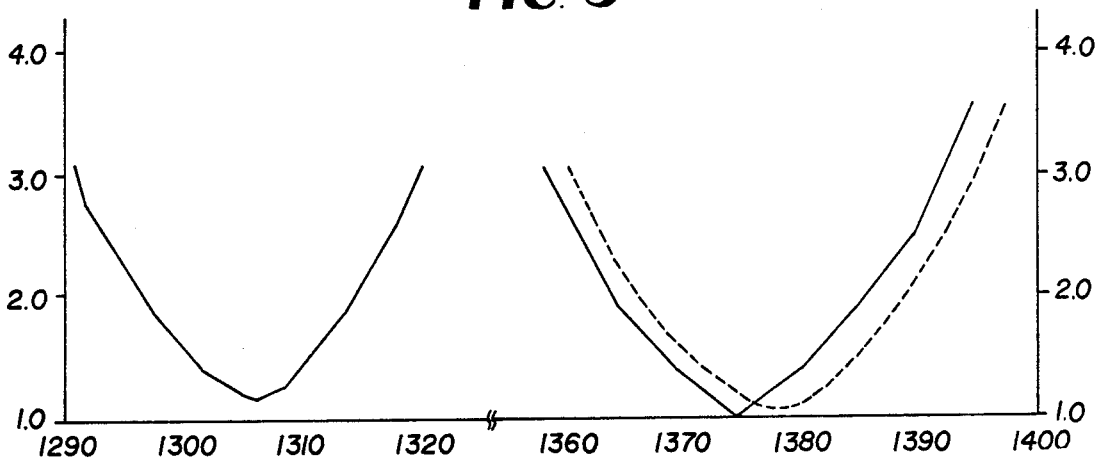
FIG. 3 is a set of curves illustrative of the effect of the polarization patch on the resonant frequency of a microstrip antenna.

In operation, when the rotatable disc 42 is oriented with the polarizing patch 34 at a first 45° angle orientation with respect to the input axis 40 as shown in FIG. 7, a first type e.g. left hand circular polarization results. If the disc 42 is rotated 90° as shown in the phantom view of the polarizing patch 34, right hand circular polarization results. When the disc is rotated such that polarizing patch 34 is parallel with the input axis, i.e. in line with the center line 40, linear polarization results at a predetermined resonant frequency while for perpendicular orientation with respect to the center line 40, linear polarization in accordance with the teachings of the above referenced U.S. Pat. No. 4,060,810 results at a lower resonant frequency. It can be seen then that for orientations of the polarizing patch 34 between the positions noted above, elliptical polarization of various axial ratios between linear and circular will result at frequencies which lie between those for parallel and perpendicular orientations of the polarizing patch as shown in FIG. 3.

Proceeding to yet another embodiment of the subject invention, reference is now made to FIG. 8, which resembles the embodiment shown in FIG. 4 with the exception of the shape of the polarizing patch which is now identified by reference numeral 34'. The polarizing patch 34' now comprises an elongated rectangle having truncated corners including the shorter dimensional side 36' and intersecting longer dimensional side 38'. What is significant is that the polarizing patch 34' is still asymmetrical relative to the input axis 40 and is oriented at an angle of 45° with respect thereto.

Tuning of the antenna element 28 can further be provided by increasing the size of the polarizing patch 34 in accordance with the teachings of U.S. Pat. No. 4,060,810 from that shown to one of a larger size as long as one of the dimensions of the patch is oriented 45° with respect to the input polarization axis.

The embodiment shown in FIG. 9 is a variation of a microstrip antenna having an elongated rectangular polarizing patch 34 centrally located within the square shaped radiating element 28. It differs from previous embodiments in that polarizing patch 34 is now oriented such that its long and short dimensions 36 and 38 are substantially parallel with the horizontal and vertical edges 32 and 33 of the radiating element 28. However, the feed point 20 as opposed to being midway along one edge 32 as shown in FIG. 4, is now located at the corner 44 to which the microstrip matching transformer 16 joins. Whereas in the earlier embodiment, the long dimension 36 was oriented diagonally across the radiating element 28, in the present embodiment the input axis 40 is oriented diagonally across the radiating element 28; however, the 45° relationship is still maintained. This embodiment furthermore is similar to the prior art embodiment shown in FIG. 1A. However the size of the radiating element 24 is smaller than the size of the radiating element 24 for the same operating frequency.

The embodiment shown in FIG. 10 is intended to illustrate that when desirable a circular shaped radiating element 46 may be resorted to when desirable. In this embodiment the elongated rectangular polarizing patch 34 is still oriented at an angle of substantially 45° with respect to the input axis 47.

As to the embodiment shown in FIG. 11, there is disclosed another type of antenna wherein more than one type of polarization such as right and left hand circular polarization can be radiated from the single radiating element 28. This embodiment also includes the polarizing patch 34, however, two separate inputs are applied along mutually orthogonal input axes 48 and 50, yet each is still oriented at an angle of 45° relative to the orientation of the polarization patch 34. In this embodiment the first input is applied as in the earlier embodiments by means of the connector 18 coupling energy to the feed point 20 via the microstrip transformer 16 joined to the mid-point of the horizontal edge 32 providing left hand circular polarization. The second input is applied at feed point 20' by means of the microstrip matching transformer 16' joined to the mid-point of the vertical edge 33 of the radiating element to provide right hand circular polarization.

It should also be pointed out that with respect to the embodiment shown in FIG. 10 that if the polarizing patch is oriented parallel to one of the orthogonal input axes i.e. axis 48 while being perpendicular to the other axis 50 as shown in the phantom view of the polarizing patch 34 a frequency diversity as well as a polarization diversity antenna results. Accordingly in light of the curves shown in FIG. 3, the input applied to feed point 20 on the bottom will result in a vertically polarized field at a higher frequency while the input at the side feed point 20' will result in horizontal polarization at a lower frequency.

Thus what has been shown and described is a symmetrically shaped microstrip antenna having a portion of its metallization removed to provide an elongated polarizing patch having a shape which is selectively disposed relative to the input axis to provide two different path lengths for respective orthogonal components of the input energy for effecting a desired polarization of the radiated field.

While there has been shown and described what is at present considered to be the preferred embodiments of the present invention, it will be readily apparent to those skilled in the art that modifications may be made thereto without departing from the spirit and scope of the invention as defined in the appended claims.

Accordingly,

I claim as my invention:

1. In a microstrip antenna consisting of an electrically conductive ground plane formed on one side of a dielectric member which has a surface of metallization on the opposite side formed in a predetermined symmetrical shape to act as a radiating element when coupled to a source of RF input energy applied along an input axis traversing the radiating element from a feed point, the dimensions of the radiating element through the center along said input axis and perpendicular thereto being substantially equal, the improvement comprising:

a polarizing patch selectively located on said radiating element and consisting of the removal of a portion of the metallization of the radiating element in a predetermined elongated pattern oriented with a major axis and a minor axis each at an angle other than perpendicular relative to said input axis so as to provide two different electrical path lengths for respective orthogonal field components of the input energy, said different path lengths being adapted to produce elliptical polarization of the energy radiated from said radiating element.

2. The microstrip antenna is defined by claim 1 wherein said angle is 45 degrees, causing said polarization to be circular.

3. The microstrip antenna as defined by claim 2 wherein said symmetrical shape comprises a regular polygon.

4. The microstrip antenna as defined by claim 3 wherein said feed point is substantially at the mid-point of one edge of said polygon.

5. The microstrip antenna as defined by claim 3 wherein said feed point is at the intersection of two adjoining edges of said polygon.

6. The microstrip antenna as defined in claim 2 wherein said radiating element is generally circular in shape.

7. The microstrip antenna as defined by claim 1 wherein said elongated pattern is of a generally rectangular shape having unequal length and width dimensions.

8. The microstrip antenna as defined by claim 7 wherein said generally rectangular pattern is oriented at an angle of substantially 45° with respect to said input axis.

9. The microstrip antenna as defined by claim 1 wherein said polarizing patch is formed on a movable microstrip antenna portion located within the region of the metallization of said radiating element for providing a selectively variable orientation of said polarizing patch relative to said input axis.

10. The microstrip antenna as defined by claim 9 wherein said movable microstrip portion comprises a rotatable disc in electrical contact with both the ground plane and the metallization of said radiating element.

11. The microstrip antenna as defined by claim 10 wherein said rotatable disc is located in the central region of said radiating element.

12. The microstrip antenna as defined by claim 1 wherein said input energy is coupled to said feed point by means of microstrip transformer means.

13. The microstrip antenna as defined by claim 1 wherein said feed point is located adjacent said polarizing patch a predetermined distance in from the outer edge of said radiating element.

14. In a microstrip antenna consisting of an electrically conductive ground plane formed on one side of a dielectric member which has a surface of metallization on the opposite side formed in a predetermined shape to act as a radiating element when coupled to a source of RF input energy applied along an input axis traversing the radiating element from a feed point, the improvement comprising:

a polarizing patch formed on a movable microstrip antenna portion located within the region of the metallization of said radiating element, said polarizing patch consisting of the removal of a selected portion of the metallization of the radiating element in a predetermined elongated pattern, providing a selectively variable orientation of said polarizing patch relative to said input axis, so as to determine the polarization of the energy radiated from said radiating element.

15. The microstrip antenna as defined by claim 14 wherein said movable microstrip portion comprises a rotatable disc in electrical contact with both the ground plane and the metallization of said radiating element.

16. The microstrip antenna as defined by claim 15 wherein said rotatable disc is located in the central region of said radiating element.

* * * * *